US005263616A

United States Patent [19]

Abplanalp

[11] Patent Number: 5,263,616

[45] Date of Patent: Nov. 23, 1993

[54] AEROSOL ACTUATING CAP WITH SIDE-MOUNTED HINGES

[76] Inventor: Robert H. Abplanalp, 10 Hewitt Ave., Bronxville, N.Y. 10708

[21] Appl. No.: 813,855

[22] Filed: Dec. 26, 1991

[51] Int. Cl.[5] ..... B65D 83/14

[52] U.S. Cl. ..... 222/402.13; 222/402.15; 222/402.21; 239/337; 239/573; 239/579

[58] Field of Search ..... 222/402.13, 402.15, 222/402.21, 402.23, 182, 509, 505; 239/337, 573, 579

[56] References Cited

U.S. PATENT DOCUMENTS

| | | | |
|---|---|---|---|
| 2,697,635 | 12/1954 | Ivins et al. | 299/95 |
| 2,953,283 | 9/1960 | Palkowski | 222/394 |
| 3,137,414 | 6/1964 | Steinkamp | 222/182 |
| 3,140,014 | 7/1964 | Lerner | 222/182 |
| 3,149,761 | 9/1964 | Harris et al. | 222/394 |
| 3,155,291 | 11/1964 | Wakeman | 239/337 |
| 3,159,319 | 12/1964 | Parish | 222/509 |
| 3,170,606 | 2/1965 | Boyer | 222/394 |
| 3,178,077 | 4/1965 | Benedetto | 222/394 |
| 3,185,349 | 5/1965 | Sagarin | 222/153 |
| 3,212,680 | 10/1965 | Crowell et al. | 222/182 |
| 3,236,421 | 2/1966 | Glazier | 222/182 |
| 3,257,044 | 6/1966 | Seaquist | 222/394 |
| 3,260,416 | 7/1966 | Abplanalp | 222/182 |
| 3,269,614 | 8/1966 | Abplanalp | 222/394 |
| 3,313,458 | 4/1967 | Braun | 222/402.13 |
| 3,317,091 | 5/1967 | Focht | 222/402.13 |
| 3,404,814 | 10/1968 | Wakeman | 222/402.13 |
| 3,409,186 | 11/1968 | Melocchi | 222/402.13 |
| 3,515,316 | 6/1970 | Green | 222/207 |
| 3,726,444 | 4/1973 | Ostrowsky et al. | 222/402.11 |
| 3,739,941 | 6/1973 | Ostrwosky et al. | 222/153 |
| 3,759,431 | 9/1973 | Vos | 222/402.21 |
| 3,887,115 | 6/1975 | Petterson | 222/402.13 |
| 3,888,392 | 6/1975 | Van Coney | 222/108 |
| 3,967,760 | 7/1976 | Marcon | 222/153 |
| 4,053,086 | 10/1977 | DeBard | 222/182 |
| 4,067,482 | 1/1978 | Vogel et al. | 222/153 |
| 4,068,782 | 1/1978 | Van der Heijden | 222/402.13 |
| 4,111,338 | 9/1978 | Cheng et al. | 222/180 |
| 4,185,776 | 1/1980 | Nozawa | 239/333 |
| 4,333,589 | 6/1982 | Bush | 222/402.11 |
| 4,354,621 | 10/1982 | Knickerbocker | 222/402.11 |
| 4,378,081 | 3/1983 | van Lit | 222/402.13 |
| 4,416,398 | 11/1983 | Knickerbocker | 222/402.13 |
| 4,426,026 | 1/1984 | Knickerbocker | 222/402.13 |
| 4,805,839 | 2/1989 | Malek | 239/337 |

FOREIGN PATENT DOCUMENTS

| | | | |
|---|---|---|---|
| 402636 | 12/1990 | European Pat. Off. | 222/402.15 |

*Primary Examiner*—Andres Kashnikow
*Assistant Examiner*—Philippe Derakshani
*Attorney, Agent, or Firm*—Davis Hoxie Faithful & Hapgood

[57] ABSTRACT

An aerosol actuating cap is disclosed for use with an aerosol container having a tilt valve. An actuator is mounted on the cap by a pair of torsion hinges. The axis of the hinges is positioned directly above the valve stem such that axis of rotation of the actuator intersects the axis of the valve stem. Upon depressing the rear of the actuator, the actuator rotates about the hinge axis. Consequently, an engagement surface contacts and displaces the valve stem and, thereby, actuates the valve. A product flue is positioned at the front of the actuator which flue is rotated with the actuator such that, on actuating the valve, the product stream from the valve stem proceeds through the flue.

20 Claims, 4 Drawing Sheets

AEROSOL ACTUATING CAP WITH SIDE-MOUNTED HINGES

FIELD OF THE INVENTION

This invention relates to a cap for aerosol containers and, more particularly, a cap utilizing an actuator which rotates about a pair of hinges.

BACKGROUND OF THE INVENTION

Aerosol containers utilize various mechanisms to discharge and direct the product. See, e.g., U.S. Pat. No. 4,426,026; 4,328,911; 4,068,782; 3,946,911; 3,888,392; 3,785,536; 3,236,421. These patents disclose cap assemblies with finger actuators which assemblies attach onto aerosol containers.

U.S. Pat. No. 4,068,782 discloses an overcap for an aerosol container with a tilt valve comprising a wall having a lid with an opening. An actuator is positioned in the opening and connected to the wall at the rear of the overcap using a bending-type hinge. A bore located in the front end of the actuator and disposed at the center of the wall encloses the valve stem of the tilt valve. Depressing the actuator causes it to rotate forward about its hinge resulting in displacement of the bore. As a result, the tilt valve is displaced by the wall of the bore and actuated. The tip of the tilt valve stem is near the top of the actuator so that the product stream does not get trapped in the cap.

U.S. Pat. No. 4,426,026 also discloses an overcap comprising a closed wall with a lid having a actuator connected at the rear end of the wall using a bending-type hinge. A product flow hole is located in the actuator directly above the valve stem. Plural projection means extending from the bottom of the actuator form a surface for engaging the valve stem. As the actuator is depressed, it rotates forward about the hinge at the rear of the wall. The engaging surface contacts the valve stem, tilting it, resulting in product flow out of the valve stem and through the product flow hole in the actuator.

Prior overcaps have a complex design that is difficult and expensive to manufacture. Further, prior overcaps generally employ levers to actuate valves that, at one end, are hingedly mounted to the cap and, at the other end, are in contact with the valve. The actuating force from a finger is applied between the two ends such that the actuating force is applied at the same point as or nearer to the hinge than the valve force. Consequently, a mechanical advantage that could result from using the lever more efficiently is lost. In fact, in some overcaps, the force locations of the actuating force and the valve force along the lever create a mechanical disadvantage, by locating the finger pad closer to the hinge than the valve stem, thereby requiring increased force to actuate the valve than is necessary.

SUMMARY OF THE INVENTION

The instant invention comprises a cap for aerosol containers having a tilt valve. The cap has an actuator that is hinged to the cap by a pair of hinges disposed coaxially at the opposite sides of the actuator. Preferably, the hinges are torsion hinges. The axis of the hinges intersects the axis of the tilt valve. When the actuator is rotated, an engaging means tilts the valve stem, thereby actuating the valve. It has been found that this invention allows for very light forces to actuate the valve but still permits precise control over the product flow. It is believed that this results from the efficient use of the actuating force, including utilization of a mechanical advantage in the actuator design, as well as the use of dual torsion hinges in a unique manner.

Preferably, the actuator, cap, and hinges are integrally molded in a single piece from an elastic material such that the hinges are shafts that twist as the actuator is depressed. Consequently, a simple one-piece design is possible with the hinges disposed on the sides of the actuator. As the actuator is released, the hinges act as torsion springs, returning the actuator to its rest position. An arcuate web is preferably mounted at the bottom of the actuator to engage the valve stem, thereby reducing the displacement of the actuator required to actuate the valve and the strain on the hinges. The finger pad of the actuator is preferably positioned so that the actuating force from the finger is further from the hinges than the force from the valve stem, thereby resulting in a mechanical advantage for the actuating force.

DETAILED DESCRIPTION

Figure 1:
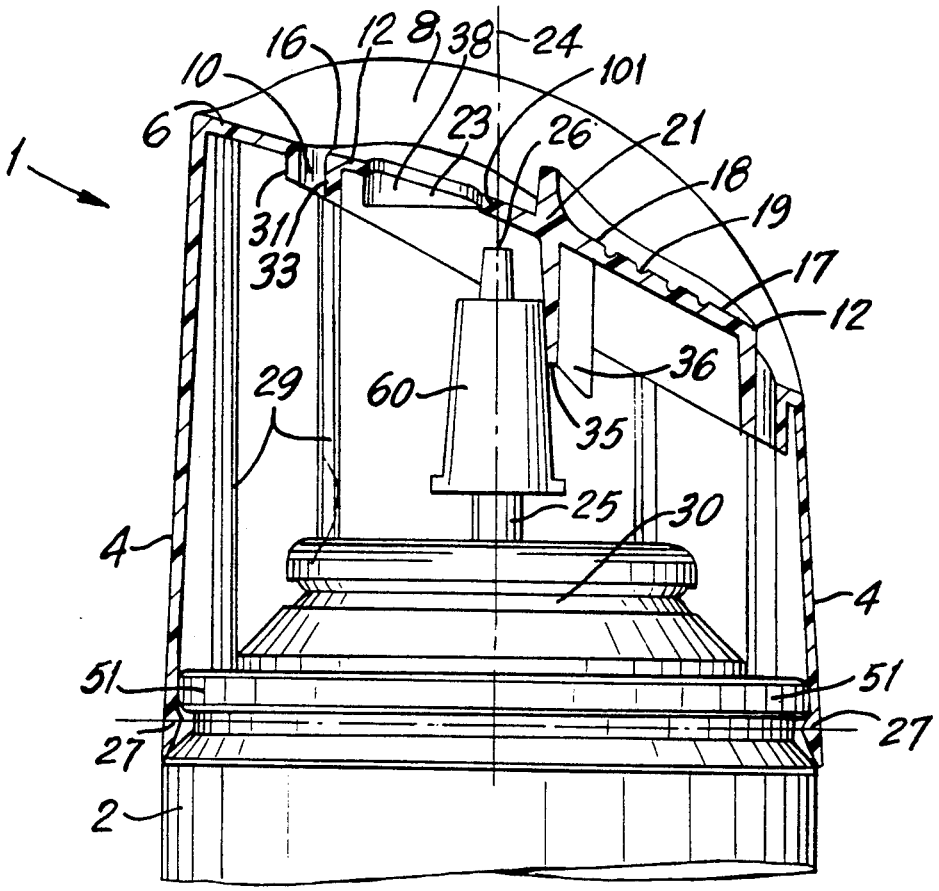
FIG. 1 is a cross-sectional side view of the cap of this invention mounted on an aerosol container in the rest condition.

FIG. 1 is a side view of the cap 1 of the present invention mounted on an aerosol container 2 (shown in part) in the rest position. The cap 1 of the present invention is composed of a closed side wall 4 that engages the top of the container 2. The outer diameter of the wall 4 near the bottom is incrementally greater than the diameter of the container 2 and narrows slightly towards the top of the wall forming a cone. The front of the wall 4 is preferably higher than the rear of the wall. A lid 6 is attached to the top of the wall 4 and slants down from the front toward the rear of the container 2.

Figure 1A:
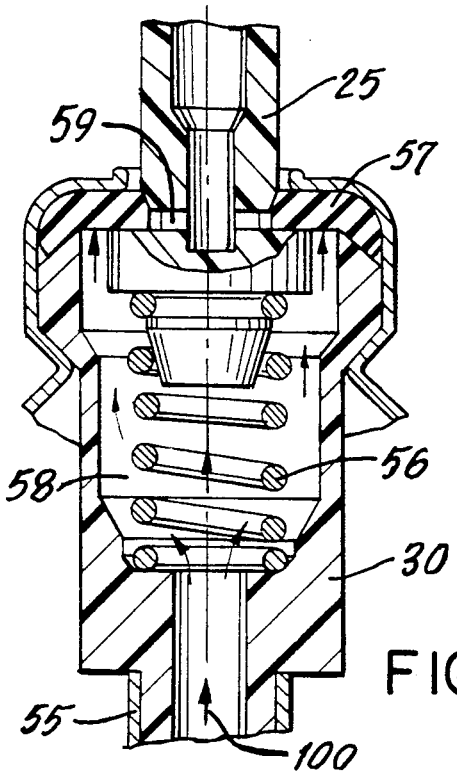
FIG. 1A is a cross-sectional side view of the valve contemplated for use with the cap of FIG. 1 in the rest position.

Typically, a bead 51 having an outer diameter slightly less than the container 2 is disposed at the top of the container. A valve 30, shown best in FIGS. 1A and 5A, is mounted at the top of the container 2. An Apache Tile Button 60, available from Precision Valve Corporation, is mounted on the valve stem 25. The button 60 is a conical casing that increases the effective diameter of the valve stem 25. A valve stem 25 extends from the valve 30, along the axis of the container 2. A valve outlet 26 is disposed concentrically at the top of the valve stem 25 so that the axis 24 of the valve stem runs through the valve outlet. While the valve stem 25 is displaced during operation of the valve 30, for purposes of this disclosure, the valve axis 24 is always the axis of the valve stem in the rest position. The tilt valve can utilize any one of the different designs known in the art for tilt actuation. The present invention is expected to be used on the PVC Tilt Actuated 202 Necked-In Container available from Precision Valve Corporation ("PVC").

FIG. 1A is a cross-sectional side view of the tilt actuated valve 30 used in the PVC Tilt Actuated 202 Necked-In Container, in the rest position. A dip tube 55 is mounted at the bottom of the tilt valve 30. The valve stem 25 is biased toward the top of the valve 30 by a spring 56 seated in a chamber 58 in the valve 30. A gasket 57 is mounted at the top of the chamber 58 which gasket sealingly engages the valve stem 25 in the rest position. A product flow path 100 (shown by arrows) runs from the bottom of the container 2 through the tube 55, into the valve 30. In the valve 30, the product flow path 100 runs through the chamber 58. In the rest position, the gasket is sealingly engaged to the valve stem 25, thereby preventing product flow. As described below, when the valve stem 25 is tilted, the valve stem breaks sealing engagement with the gasket 57, permitting product flow through a passage 59 in the valve stem that leads to the valve outlet 26.

Referring to FIG. 1, an opening 10 is located in the lid 6 and encloses the axis 24 of the valve stem 25 when the cap 1 is mounted on the container 2. An actuator 12 is positioned within the opening 10, evenly spaced from the edges of the opening. The axis 24 of the valve stem 25 divides the actuator into a front portion 16 and a rear portion 17. The hinge axis 14*a*, which intersects the axis 24 of the valve stem 25, also divides the actuator 12 into the front portion 16 and the rear portion 17. As described more fully below, when the operator exerts force down on the rear portion 17, the actuator 12 is rotated about a point which is disposed above of the outlet 26 of the valve stem 25, i.e., on the valve axis 24.

A finger pad 18 is located on the rear portion 17 of the actuator 12 where the operator's finger will apply the actuating force. The finger pad 18 is preferably composed of finger ridges 19 and a finger lip 21. The finger ridges 19 are positioned on the rear portion 17 of the actuator 12 in order to improve the grip of an operator's finger. The curved lip 21 is positioned on the rear portion 17 and in front of the ridges 19. The curved surface of the lip 21 cradles the finger to increase comfort and improve grip. Further, the location of the actuating force from the finger can be thereby controlled such that a mechanical advantage is obtained by requiring the finger to contact the actuator 12 at a point further from the pivot of the actuator located at the hinge 14 (FIG. 2) than the point at which the force of displacing the valve stem 25 contacts the actuator.

A product flue 23 is located in the front portion 16 of the actuator 12. The product flue 23 is more clearly shown in FIG. 2, a top view of the cap 1 of the present invention. The rear of the flue 23 is disposed slightly in front of the valve outlet 26 when the actuator 12 is in its rest position. As described more fully below, the flue 23 is positioned such that when the actuator 12 is rotated to actuate the valve 30, the flue is located directly in line with the displaced valve outlet 26 and the product stream.

In the preferred embodiment, chords 27 protrude from the inner surface of the wall 4 near the bottom of the wall. When the cap 1 is mounted onto the container 2, the chords engage the bead 51, preventing the cap from sliding off. Any cap attachment means known in the art, however, would suffice to practice the invention.

Ribs 29 are preferably mounted on the inner surface of the wall 4. The ribs 29 comprise flanges protruding radially inward, extending from the lid 6 to a point near the bottom of the wall but above the chords 27. Sufficient space exists between the bottom of the ribs 29 and the chords 27 to accommodate the bead 51. The ribs 29 give added strength to the cap 1 and prevent the cap from sliding too far down on the container 2.

A support wall 31 is preferably located on the bottom of the lid 6 at the edge of the opening 10. Similarly, a support ridge 33 is preferably disposed at the periphery of the actuator 12, extending downwardly. The support wall 31 and support ridge 33 strengthen the lid 6 and actuator 12, respectively, preventing them from deforming during use and add to the overall aesthetic appearance of the cap.

Figure 3:
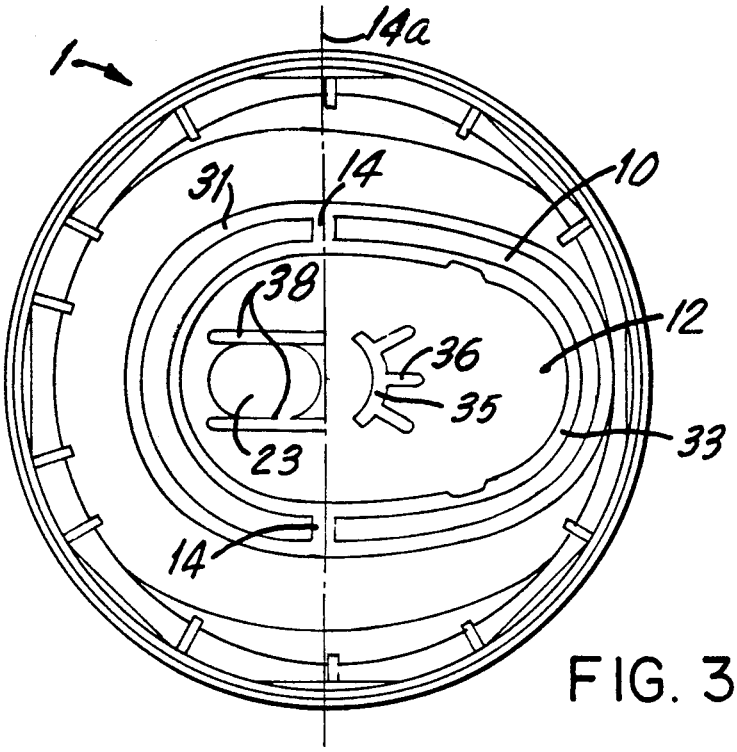
FIG. 3 is a bottom elevational view of the cap of FIG. 1.

A means for engaging the tilt button 60 of the valve stem 25 when the actuator 12 is rotated is mounted on the cap 1. Preferably, a valve actuating web 35 extends down from the bottom of the actuator 12 in the rear portion 17. As seen in FIG. 3, a bottom view of the cap of FIG. 1, the bottom of the web 35 is in the shape of a circular arc, centered at the axis of the wall 4. The bottom of the web 35 extends just below the top of the tilt button 60. Preferably, the bottom of the web 35 is near the top of the button 60 such that the mechanical advantage of the web on the stem 25 is maximized. In the rest condition, the web is separated from the button 60 by a very small distance (preferably 50 thousandths inch or less). Web trusses 36 are preferably attached to the bottom of the actuator 12 and the rear face of the web 35 in order to give lateral support to the web, preventing the web from bending back as it contacts the button 60 during operation.

Ramped barriers 38 protrude from the bottom of the actuator 12 adjacent to the product flue 23. The barriers 38 add some strength to the actuator 12, helping to prevent deformation of the actuator.

Figure 2:
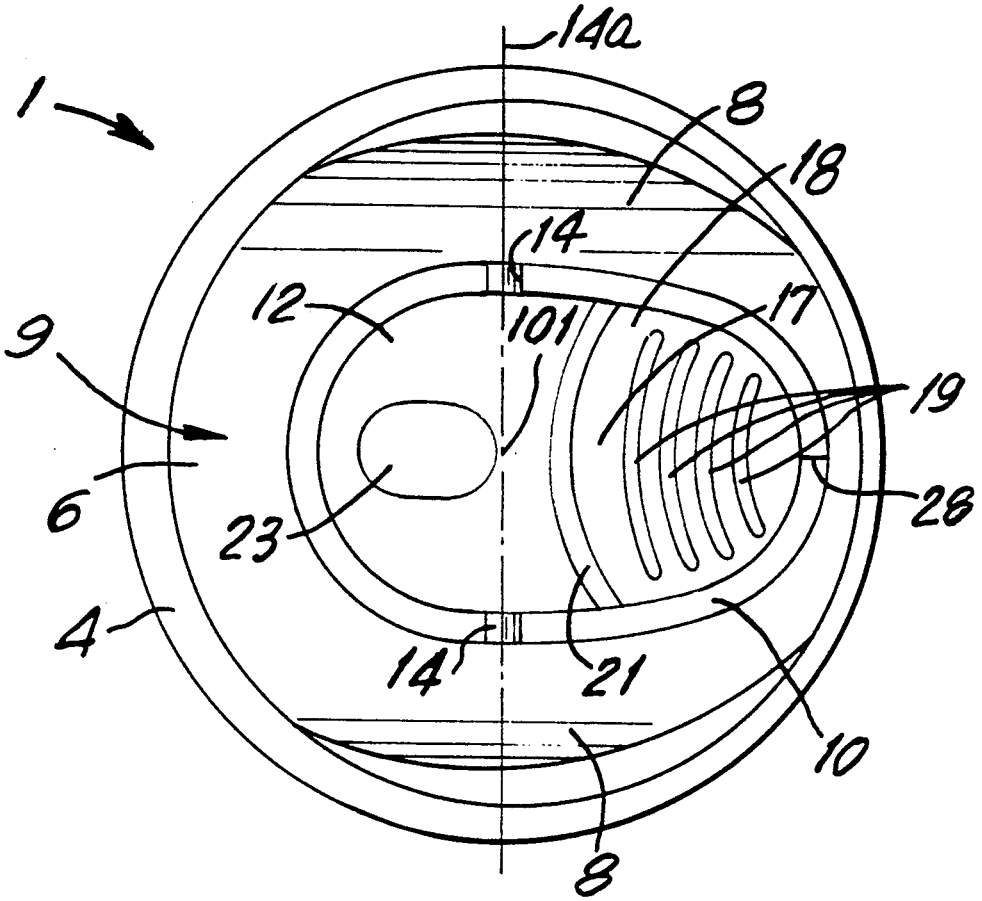
FIG. 2 is a top elevational view of the cap of FIG. 1.

FIG. 2 is a top elevational view of the cap 1 of FIG. 1. Hinge shafts 14 are mounted coaxially on the sides of the actuator 12 such that the axis of the hinge shafts runs through the axis of the wall 4. Preferably, the hinge shafts 14 are mounted at the bottom of the support ridge 33. Since the wall 4 and the container 2 are coaxial when the cap 1 is mounted on the container, the axis 14*a* of the hinge shafts 14 intersects the axis 24 of the valve stem 25 at 101, as shown in FIGS. 1–3. The hinge shafts 14 are also mounted to side portions 8 of the lid 6. Preferably, the hinge shafts 14 are mounted at the bottom of the support wall 31. Preferably, the entire cap 1 including the lid-hinge-actuator assembly is integrally molded from a single piece of polypropylene, preferably a homopolymer with a melt between 6–18 or PD701 with a melt of 35. However, the hinge shafts 14 could be any hinges mounted at the sides of the actuator 12 and still practice the invention. The hinge shafts are preferably 80–175 thousandths inch, back to front, by 40–90 thousandths inch, top to bottom. Hinge shafts of 160×80 thousandth inch centered 210–220 thousandths inch from the top of the actuator 12 are currently preferred for use with the PVC Tilt Actuated 202 Necked-In Container.

Preferably, the opening 10 is nearly oval-shaped, tapering down slightly from the front to the rear. The actuator 12 has the same shape as the opening 10 and is evenly spaced from the edges of the opening.

A lock tab 28 is preferably attached to the rear portion 17 of the actuator 12 and the rear of the lid 6. The lock tab 28 prevents the actuator 12 from accidentally rotating and thereby actuating the valve 30 during shipping. The lock tab 28 is removed before use.

FIG. 3 is a bottom elevational view of the cap 1 of FIG. 1. The web 35 is a portion of a circular arc with its center located at the axis of the wall 4. When the cap 1 is mounted on the container 2, the axis of the wall 4 should be coincident with the axis 24 of the valve stem 25. Consequently, the web 35 partially encloses the valve stem 25 and the button 60. The web 35 has a radius of curvature larger than the button 60 so that if the stem axis 24 and the center of the web do not precisely align, the web will still engage the button as the actuator 12 is rotated.

Figure 4:
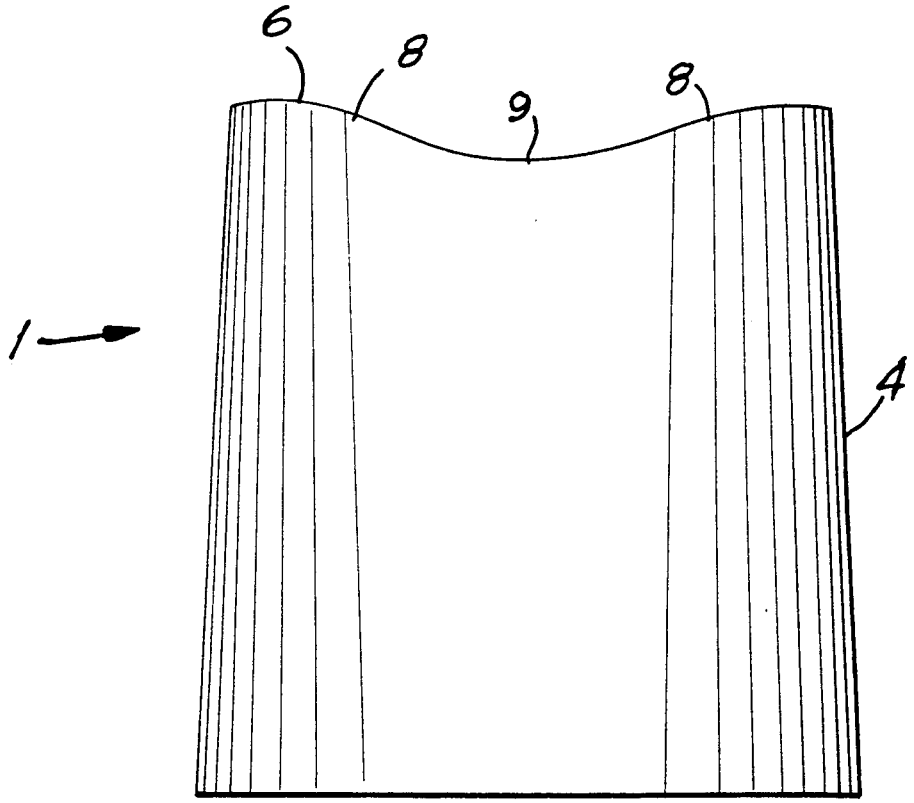
FIG. 4 is a front elevational view of the cap of FIG. 1.

FIG. 4 is a front view of the cap 1 of FIG. 1. The lid 6 preferably curves down along slanted side portions 8 to create a channel 9 in the center of the lid, running downward from front to back. The finger of the operator can fit comfortably in the channel 9 as the container 2 is held from the rear.

To attach the cap 1 to the container 2, the cap is pushed onto the container 2. The bead 51 at the top of the container 2 deforms the wall 4 as it contacts the chords 27. As the chords 27 slide over the bead 51, the wall 4 returns to its nondeformed position with the chords locked under the bead. The ribs 29 prevent the cap 1 from sliding too far down the container 2. At this point, the valve stem 25 is disposed generally coaxially within the wall 4 of the cap 1 (as shown in FIG. 1).

Figure 5:
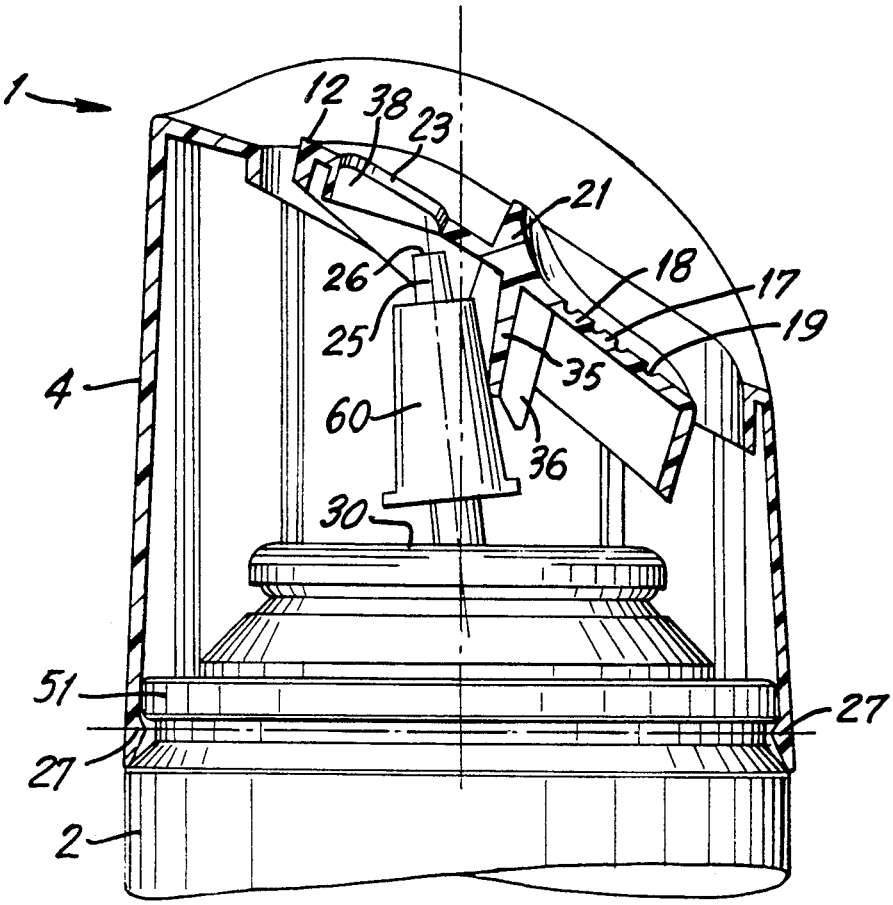
FIG. 5 is a cross-sectional side view of the cap of FIG. 1 in the actuated condition.
Figure 5A:
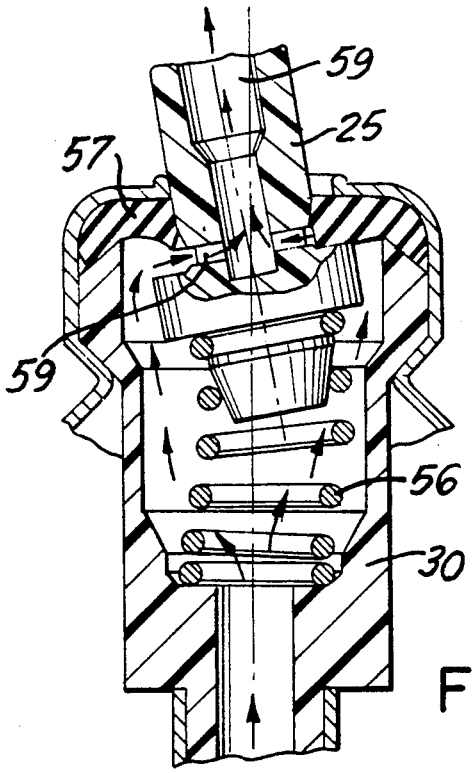
FIG. 5A is a cross-sectional side view of the valve mechanism contemplated for use with the cap of FIG. 1 in the actuated position.

FIG. 5 is a cross-sectional side view of the cap 1 of FIG. 1 in the actuated position. To operate the aerosol container utilizing the cap 1 of the present invention, the operator grasps the container 2 such that a finger rests on the rear portion 17 of the actuator 12. The finger tip rests on the finger ridges 19 and abuts the finger lip 21. The operator depresses the rear portion 17, causing the actuator 12 to rotate backwards in the hole 10 about the axis of the hinge shafts 14 (position indicated) as the hinge shafts twist. Rotating the rear portion 17 of the actuator 12 causes the arcuate web 35 to contact and displace the button 60 which tilts the valve stem 25.

FIG. 5A is a cross-sectional side view of the valve 30 in the actuated position. The valve stem 25 is tilted thereby displacing the passage 59 from sealed engagement with the gasket 57, permitting product flow through the passage and out the valve outlet 26. The valve stem 25 resists displacement due to the forces of the spring 56 and the gasket 57, resulting in a force on the web 35. When the actuating force on the actuator 12 is removed, the spring 56 returns the valve stem 25 to its rest position in sealed engagement with the gasket 57, closing the passage 59, as shown in FIG. 1A. Referring again to FIG. 5, the force on the web 35 acts on the actuator 12 at the point where the web joins the actuator. Preferably, the web 35 is positioned nearer the hinge shafts 14 than the finger lip 21 so that a mechanical advantage in operating the cap 1 is obtained.

As the rear portion 17 is rotated downward and forward, the front portion 16 of the actuator 12 is rotated upward and rearward. Consequently, the product flue 23 is displaced upward and rearward. The valve outlet 26, which was directed at the actuator 12, is moved forward as the valve stem 25 is tilted, such that the valve outlet and the product stream are now directed forward and coincide with the product flue 23, as shown in FIG. 5. As a result, the product stream is directed through the flue 23 which is sized such that the product stream will go through the flue even if there is a small error in alignment between the cap 1 and the container 2.

After propelling the desired amount of product, the operator releases the rear portion 17 of the actuator 12. The hinge shafts 14, acting as torsion springs, rotate the actuator 12 back to the original position, allowing the valve stem 25 to return to its original position and stop product flow. It should be noted that even if the hinges created no torsional spring force, the force from the valve stem 25 through the button 60 upon the actuator 12 as the stem naturally returned to its closed position would be sufficient to return the actuator to its original position, ready for the next use.

It has been found that the cap made in accordance with the present invention is easier to actuate than caps of the prior art. This makes the product more attractive to consumers and prevents finger fatigue during prolonged use.

I claim:

1. A cap for an aerosol container having a tilt valve with a valve stem that defines a first axis, the cap comprising:

a wall capable of being attached to the container;

an actuator;

a pair of hinges attaching the sides of the actuator to the wall such that the actuator is capable of rotating about a second axis wherein the first axis and the second axis intersect; and a means for contacting and displacing the valve stem when the actuator is rotated.

2. The cap of claim 1 wherein the hinges are torsion hinges.

3. The cap of claim 2 wherein the hinges comprise elastic solid members fixedly attached to the actuator.

4. The cap of claim 3 wherein the hinges are fixedly attached to the wall.

5. The cap of claim 1 wherein the contacting means comprises an actuating web for engaging the valve stem.

6. The cap of claim 5 wherein the contacting means further comprises web trusses mounted on the web and the actuator.

7. The cap of claim 5 wherein the actuator further comprises a finger pad located further from the hinges than the web.

8. The cap of claim 1 wherein the actuator contains a product flue located in the front of the actuator

9. The cap of claim 1 wherein the wall further comprises a lid mounted at a point on the wall distal from the point where the wall engages the container.

10. The cap of claim 9 wherein the hinges are mounted on the lid of the wall and on the actuator.

11. A cap assembly comprising:

an aerosol container with a tilt valve having a valve stem that defines a first axis; and a cap mounted on the container further comprising:

a cap wall;

an attachment means disposed at a first end of the wall for mounting the cap onto the container;

a lid mounted at a second end of the wall;

an operating means comprising an actuator hingedly mounted by a hinge means on the lid such that the actuator is capable of rotating about a second axis wherein the second axis intersects the first axis and wherein a portion of the actuator is capable of contacting and displacing the valve stem when the actuator is rotated.

12. The assembly of claim 11 wherein the actuator rotation axis intersects the valve stem axis.

13. The assembly of claim 11 wherein the hinge means is an elastic solid member fixedly mounted to the actuator and fixedly mounted to the lid.

14. The assembly of claim 11 wherein the actuator further comprises an engagement means disposed at the bottom of the actuator adjacent to the valve stem when the cap is mounted on the container which engages the stem as the actuator is rotated.

15. The assembly of claim 14 wherein the engagement means is an arcuate web.

16. The assembly of claim 14 wherein the actuator further comprises a finger pad at the top of the actuator disposed further from the hinge means than the web.

17. The assembly of claim 11 wherein the actuator contains a product flue distal from the portion of the actuator contacting the valve stem.

18. A cap for an aerosol container having a tilt valve with a valve outlet, the tilt valve having a valve stem that defines a valve axis, and a button connected to the valve stem comprising:

a closed outer wall having an inner face and an outer face;

a lid mounted on the top of the wall extending inward wherein an opening is disposed in the lid;

an actuator having a front portion and a rear portion wherein a product flue is located in the front portion and a finger pad is located in the rear portion;

two torsion hinges with a common longitudinal hinge axis, the hinges mounted on opposite sides of the actuator such that the hinge axis intersects the valve axis and separates the front portion from the rear portion, the torsion hinges being mounted to the lid at the edge of the opening such that the actuator may rotate about the hinge axis within the opening;

a means for engaging the aerosol container such that the hinge axis is disposed proximate to the valve outlet; and an actuating web mounted on the bottom of the actuator disposed rearwardly of the hinge axis which web extends below the top of the bottom and adjacent to the bottom when the cap is mounted to the container.

19. The cap of claim 18 wherein the torsion hinges are elastic solid members fixedly mounted to the actuator and fixedly mounted to the lid.

20. The cap of claim 18 wherein the actuator further comprises ramped barriers disposed adjacent to the product flue at the bottom of the actuator for directing product flow.

* * * * *